United States Patent [19]

McLay

[11] 4,040,589

[45] Aug. 9, 1977

[54] INTERCONNECTING BRACKET FOR LOGS

[76] Inventor: Roger Berry Cameron McLay, 72 The Serpentine, Bilgola Beach, New South Wales 2107, Australia

[21] Appl. No.: 670,461

[22] Filed: Mar. 25, 1976

[30] Foreign Application Priority Data

Apr. 3, 1975 Australia ..... 1101/75

[51] Int. Cl.[2] ..... A47F 5/00

[52] U.S. Cl. ..... 248/300; 403/406; 248/217.1; 247/217.3

[58] Field of Search ..... 248/221 R, 221 B, 221 C, 248/221 F, 221 G, 300; 52/233; 403/188, 346, 386, 406

[56] References Cited

U.S. PATENT DOCUMENTS

| | | | |
|---|---|---|---|
| 855,777 | 6/1907 | Heberger | 403/406 |
| 1,676,485 | 7/1928 | Finucane | 248/300 |
| 1,767,575 | 6/1930 | Bujack | 248/300 |
| 1,768,547 | 7/1930 | Englund | 403/406 |
| 2,835,002 | 5/1958 | Majewski | 403/406 |
| 2,884,670 | 5/1959 | Garrison et al. | 248/300 |
| 3,000,145 | 9/1961 | Fine | 403/346 |
| 3,345,029 | 10/1967 | Palmer | 248/300 |
| 3,539,138 | 11/1970 | Desroches | 248/300 |

FOREIGN PATENT DOCUMENTS

| | | | |
|---|---|---|---|
| 32,973 | 10/1922 | Netherlands | 52/233 |

*Primary Examiner*—Robert A. Hafer
*Attorney, Agent, or Firm*—Ladas, Parry, Von Gehr, Goldsmith & Deschamps

[57] ABSTRACT

A bracket formed singly, or in an interconnected row in strip form, which is positioned between adjacent logs in a stack to stabilize the stack, the bracket having a generally flat base for nailing upon the lower log and four depending projections to grip same in several positions, said projections being arranged in pairs with the projections of each pair being symmetrical about the mid point of the base, and upstanding and outwardly diverging arms from opposite ends of the base for supporting the upper log and having claws for gripping same.

14 Claims, 5 Drawing Figures

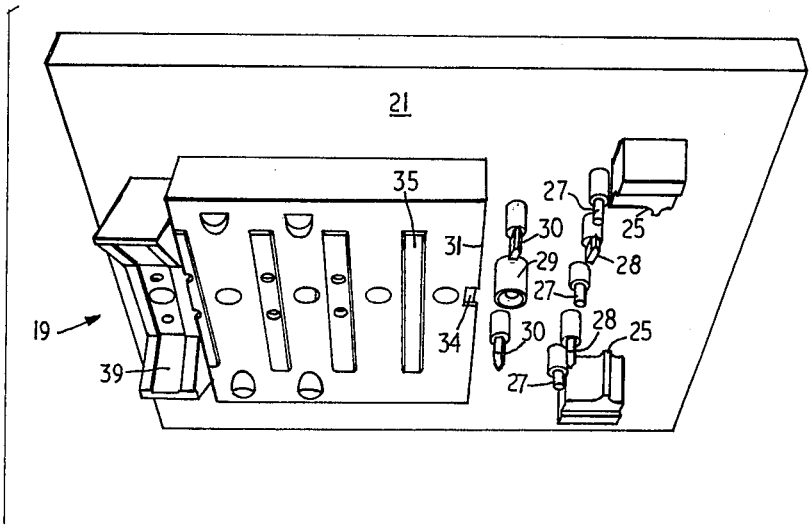
FIG.5
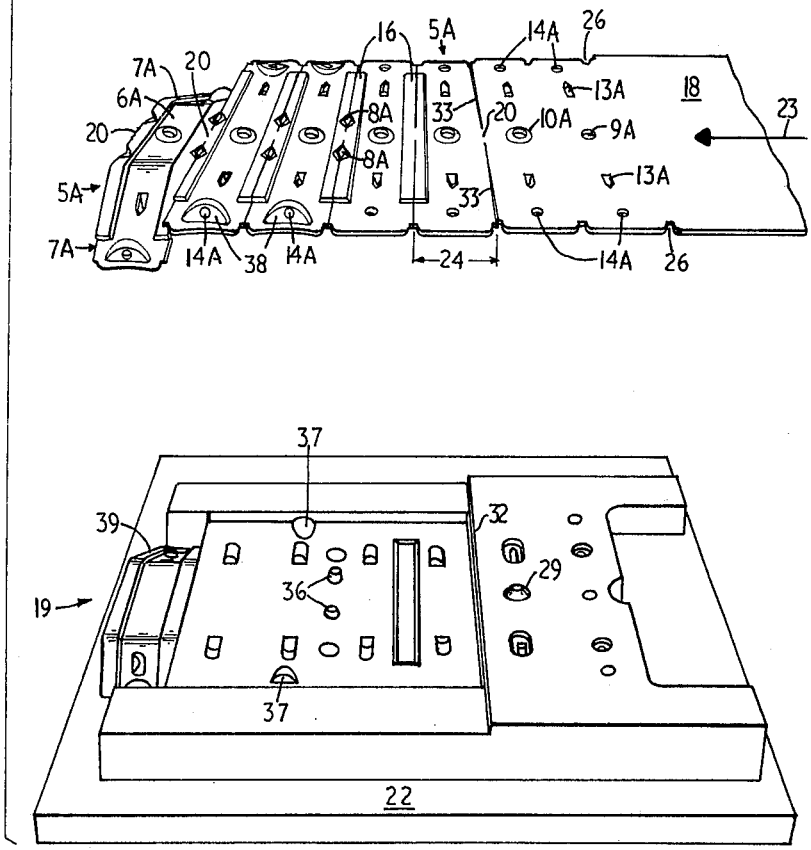

INTERCONNECTING BRACKET FOR LOGS

This invention relates to means for interconnection of timber logs to facilitate stacking to form a wall, box, or the like.

A stack of timber logs is frequently used to serve as a retaining wall, garden materials container, fencing, planters and the like. Such stacks have been composed of logs laid one upon the other in parallel alignment and/or alternately laid one across another. Hitherto the stack of logs has been vertically drilled and skewered together, or supported by unsightly props.

It is the principal object of this invention to provide a simple and effective means of supporting timber logs in a stack.

According to one general form of the invention there is provided a bracket for interconnecting adjacent logs in a stack of logs to stabilise said stack, comprising a base, means for fastening said base upon a log, four depending projections arranged in pairs, the projections of each of said pairs being substantially symmetrical about the mid point of the base for gripping of said log in any one of a plurality of relative angular dispositions between said base and said log. A pair of spaced support arms upstanding from opposite parts of the base to accommodate an upper adjacent log therebetween, and means on said support arms facilitating gripping of said arms to said adjacent log.

Exemplary embodiments are illustrated in the accompanying drawings, in which.

Figure 1:
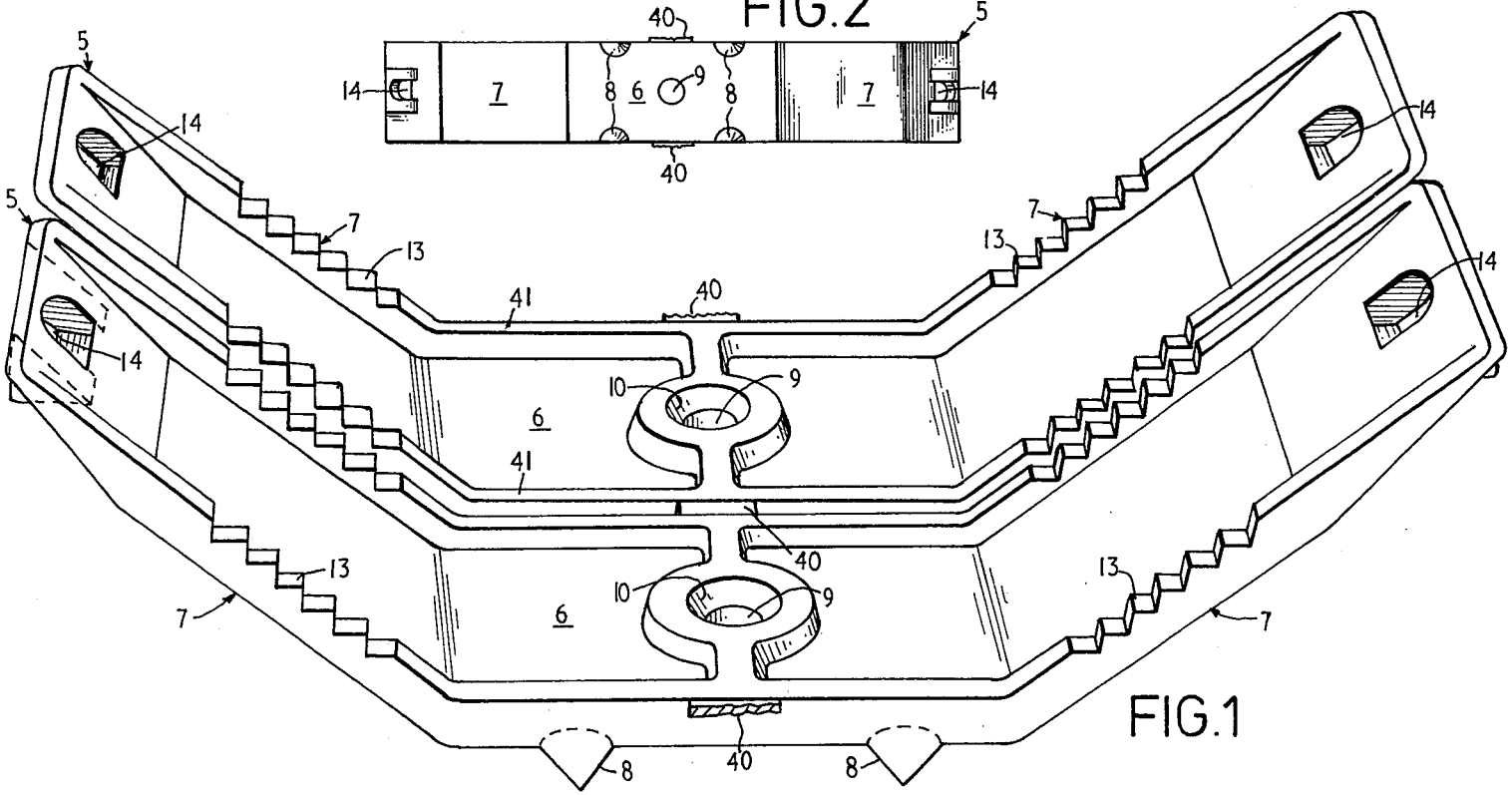
FIG. 1 is a perspective view of two plastic brackets joined by a tearable membrane, which illustrate a first embodiment.

An exemplary embodiment of the invention will now be described, especially suited for forming as a moulded plastic product, according to which the bracket 5 consists of an oblong base 6, the opposite ends of which are extended to form upwardly extending and outwardly sloping arms, or wings 7. A series of depending projections 8 are provided in the underside of the base 6 and are arranged in a square, or rectangular, shaped array. As four such projections 8 are provided they may occur each at a respective corner of the array and in pairs with the projections of each of the pairs being substantially symmetrical about the mid point of the base 6. Thus, a log beneath the base may be gripped by the projections 8 in any one of plural relative angular dispositions between the log and base 6. A single medial hole 9, which may be countersunk as at 10, is provided in the base 6. Reinforcement of the support arms 7 preferably is attained by the provision of lateral ribbing 41 extending along the base 6 and at least part of the length of the support arms 7.

Figures 3, 4:
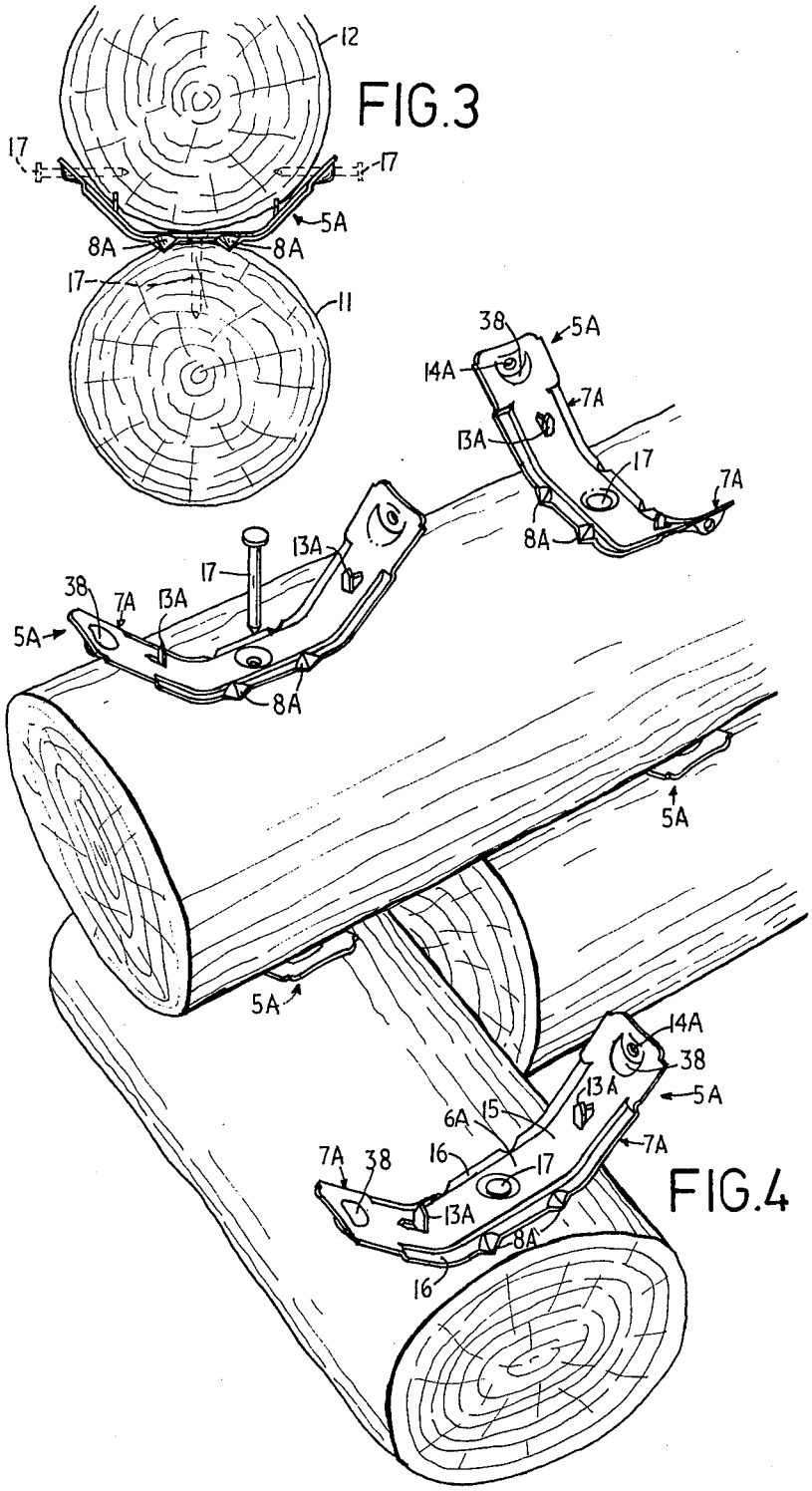
FIG. 3 is an end elevation of a pair of logs joined by a metal bracket which illustrates a second embodiment.
FIG. 4 is a perspective view of brackets according to the embodiment shown in FIG. 2 joining several logs at the corner of a wall; and, FIG. 5 is an exploded perspective view of a set of dies adapted to form metal brackets from a continuous strip.

The bracket may be composed of any other suitable material such as galvanised metal sheeting and such a bracket 5A is shown in FIGS. 3 to 5. Where metal sheeting is utilised a reinforcing gusset 15 for the upstanding support arms 7A may be defined by one or more impressions in the base which extends its entire length and partway along said arms 7A. Preferably, a pair of lateral impressions 16 are provided which terminate short of the end of each arm 7A to permit inward bending of these ends from hammer blows with or without application of fixing nails 17. Gripping claws 13A and projections 8A similar to those described above may be provided in the arms 7A.

The above-described bracket 5 or 5A is intended to be applied to the upper portion of the periphery of a log 11 by nailing, by nails 17, or screwing, via its medial hole in the base 6A of the bracket whereby the depending projections 8A become at least partly embedded in the timber to stabilise the bracket thereon and thereby to contribute to the stability of the stack. The upper adjacent log 12 in the stack may then be lowered between the arms of the bracket to be gripped by an intermediate inward facing claw 13A on each arm 7A. To facilitate further gripping nail or screw holes 14A may be provided in the outer end portion of each arm 7A. It will be appreciated that by the square-shaped array of the base projections 8 and 8A the bracket 5 or 5A may be positioned in either one of two positions 90° apart, or any other position, to enable stacking of logs 11 and 12 in parallel or intersecting alignment.

In an alternative form (not shown) the base of the bracket 5 may be constructed in two overlying pivoted parts with the upstanding support arms 7 formed integrally with the upper part and the depending projections 8 carried by the lower part. In the latter construction the pattern of the array of projections 8 will be less important from the point of view of provision of different available seating positions upon the log.

When formed from sheet metal stock 18 (see FIG. 5) an especially advantageous arrangement is to pass the continuous stock 18 intermittently through a multistage forming tool with adjacent brackets 5A remaining partially connected in juxtaposition so that an interconnected continuous row of brackets 5A issues forth from the tool. The interconnection 20 is such, however, as to permit ready manual separation. Considerable convenience in storage, transport or further processing, such as paint dipping, results from the supply of plural brackets 5A in a connected strip of a selected length.

One method of production of these strips as shown in FIGS. 3, 4 and 5 is as follows:

A forming tool such as a die set 19 is provided and comprises an upper die plate 21 and a lower die plate 22. A series of interacting punching and forming tools are secured to each plate 21 and 22. The plate 21 of the die set 19 is secured to the moving component of a suitable press, and the plate 22 to the base table of said press. The metal strip stock 18 is progressively fed through between the plates 21 and 22 by an indexing mechanism of known form. The strip 18 is moved in the direction of the arrow 23 by a distance 24, equal to the width of a bracket 5A, between each working stroke of the press.

As the strip 18 enters the die set 19 two punching tools 25 trim the lateral sides of the strip 18 and form an indentation 26. The strip is then indexed through the distance 24 and, during the next power stroke, three punches 27 produce holes 9A and 14A. Additionally, contoured punches 28 at the same time punch out gripping claws 13A. At the next indexation, a countersinking tool combination 29 provides countersinking 10A about the hole 9A. Additionally, bending tools 30 force the gripping claws 13 to the required angle with respect to the bracket 5A.

A further indexation brings the strip 18 to the shearing station whereat coacting guillotine blades 31 and 32 partially shear the metal at 33. The upper guillotine blade 31 is relieved at 34 so that an unsheared portion 20 is left in the centre of the strip 18.

At further progressive indexation a punch 35 produces the lateral impressions 16, conical punches 36 form depending projections 8A, and punches 37 force the metal surrounding the holes 14A into a pocket 38. It will be seen that these pockets are so shaped that nails 17 pass through holes 14A at an inclined angle to the arms 7A. Finally, a bending tool combination 39 bends the arms 7A to the required angle with respect to the base 6A. A series of brackets 5A will emerge from the die set 19, with said brackets joined together only at the unsheared points 20. The metal is however in a partially sheared state even at the points 20 so that individual brackets 5A may be broken off as required.

Figure 2:
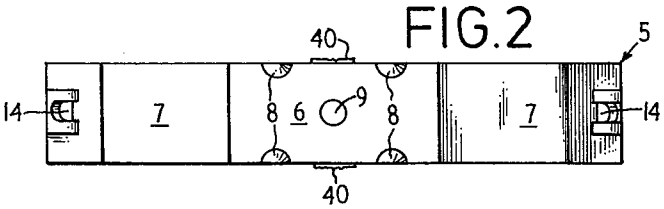
FIG. 2 is an inverted plan to a reduced scale of the embodiment shown in FIG. 1.

Referring again to the first embodiment shown in FIGS. 1 and 2, the plastic brackets 5 are joined by a tearable membrane or sprew 40 so that these plastic brackets 5 are also produced preferably in gangs of ten. Individual brackets 5 can be torn from the gang as required.

Several forms have been described in the foregoing passages but it should be understood that other embodiments, modifications and refinements are possible within the scope of this invention. It will be noted that the projections 8 or 8A in both embodiments are disposed in pairs laterally and at opposite sides of the base 6 or 6A. This disposition is particularly advantageous in the latter embodiment where it can be seen that by means of the punches 36 striking at the join between a pair of adjacent brackets the projections 8A are formed simultaneously on two adjacent sides as effective triangular-shaped sprigs. It is stated above that these punches 36 are conical but preferably they are pyramidal.

What I claim is:

1. A bracket for interconnecting adjacent logs in a stack of logs to stabilise stack, comprising a generally flat base for fastening upon a log, four depending projections arranged in pairs, the projections of each of said pairs being substantially symmetrically disposed about the mid point of the base for gripping of said log in any one of a plurality of relative angular dispositions between said base and said log, a pair of spaced support arms upstanding from opposite parts of the base to accommodate an upper adjacent log therebetween, means for reinforcing said support arms which includes lateral upstanding ribbing extending along said base and part way along said arms, and serrations on said ribbing facilitating gripping of said arms to said adjacent log.

2. A bracket according to claim 1, wherein each of said support arms outwardly diverge from said base with a hole located in a pocket near the outer end of each of said arms, the axis of said hole being inclined to the plane of its arm.

3. A bracket according to claim 1, wherein at least one pair of said projections is laterally disposed on opposite sides of said base.

4. A bracket according to claim 1, wherein all four of said projections are disposed laterally on said base.

5. A bracket according to claim 1, wherein all four of said projections are disposed substantially symmetrically about the mid point of said base.

6. A bracket according to claim 1, wherein said base is formed with a medial nail hole for fastening said bracket by neal upon the upper periphery of a log.

7. A bracket according to claim 1, in combination with a plurality of like brackets disposed in a row and interconnected by a readily fracturable membrane disposed laterally between adjacent ones of said brackets.

8. A bracket for interconnecting adjacent logs in a stack of logs to stabilise said stack, comprising a generally flat base for fastening upon a log, four depending projections arranged in pairs, the projections of each of said pairs being substantially symmetrically disposed about the mid point of the base for gripping of said log in any one of a plurality of relative angular dispositions between said base and said log, a pair of spaced support arms upstanding from opposite parts of the base to accommodate an upper adjacent log therebetween, means for reinforcing said support arms which includes opposite lateral impressions from which said projections depend and which extend along said base and part way along said arms, and inwardly facing pointed tabs each in the form of a claw on said support arms to facilitate gripping of said arms to said adjacent log.

9. A bracket according to claim 8, wherein each of said support arms outwardly diverge from said base with a hole located in a pocket near the outer end of each of said arms, the axis of said hole being inclined to the plane of its arm.

10. A bracket according to claim 8, wherein at least one pair of said projections is laterally disposed on opposite sides of said base.

11. A bracket according to claim 8, wherein all four of said projections are disposed laterally on said base.

12. A bracket according to claim 8, wherein all four of said projections are disposed substantially symmetrically about the mid point of said base.

13. A bracket according to claim 8, wherein said base is formed with a medial nail hole for fastening said bracket by nail upon the upper periphery of a log.

14. A bracket according to claim 8, in combination with a plurality of like brackets disposed in a row and interconnected by a readily fracturable membrane disposed laterally between adjacent ones of said brackets.

* * * * *